US008115368B2

(12) United States Patent
Cho

(10) Patent No.: US 8,115,368 B2
(45) Date of Patent: Feb. 14, 2012

(54) COOLING APPARATUS OF DISCHARGE LAMP

(75) Inventor: Heon-Gu Cho, Incheon (KR)

(73) Assignee: SK America, Inc., Fairfield, NJ (US)

( * ) Notice: Subject to any disclaimer, the term of this patent is extended or adjusted under 35 U.S.C. 154(b) by 334 days.

(21) Appl. No.: 12/314,391

(22) Filed: Dec. 9, 2008

(65) Prior Publication Data

US 2009/0153061 A1 Jun. 18, 2009

(30) Foreign Application Priority Data

Dec. 18, 2007 (KR) ..... 20-2007-0020283 U

(51) Int. Cl.
*H01J 5/50* (2006.01)

(52) U.S. Cl. ..... 313/45

(58) Field of Classification Search ..... 313/318.01, 313/45–46

See application file for complete search history.

(56) References Cited

U.S. PATENT DOCUMENTS

| | | | | |
|---|---|---|---|---|
| 4,300,073 | A * | 11/1981 | Skwirut et al. | 315/53 |
| 4,449,071 | A * | 5/1984 | Yokoyama | 315/53 |
| 4,739,222 | A * | 4/1988 | Nomoto et al. | 315/57 |
| 6,351,082 | B1 * | 2/2002 | Fah | 315/291 |
| 2006/0232984 | A1 * | 10/2006 | Schuknecht et al. | 362/373 |
| 2007/0109777 | A1 * | 5/2007 | Zhang et al. | 362/218 |
| 2007/0285926 | A1 * | 12/2007 | Maxik | 362/294 |

* cited by examiner

*Primary Examiner* — Toan Ton
*Assistant Examiner* — Hana Featherly
(74) *Attorney, Agent, or Firm* — Sunny Kim

(57) ABSTRACT

Disclosed is a cooling apparatus of a discharge lamp for applying a heat spreading plate to a high intensity discharge lamp or for applying both a heat spreading plate and a cooling fan to a high intensity discharge lamp so as to improve the durability of an embedded electronic ballast and to increase an optical output efficiency of a discharge lamp.

1 Claim, 4 Drawing Sheets

COOLING APPARATUS OF DISCHARGE LAMP

FIELD OF THE INVENTION

The present invention relates to a cooling apparatus of a discharge lamp, and more particularly, to a cooling apparatus for cooling the heat generated in a discharge lamp which embeds a high intensity electronic ballast.

BACKGROUND OF THE INVENTION

In general, a discharge lamp is a light source that uses a discharge phenomenon generated in gas or vapor. Discharge in the discharge lamp may be arc discharge or glow discharge, or may be a discharge which a fluorescent material is applied in a tube of a low pressure mercury lamp. The discharge lamp comprises a carbon-arc lamp, a sodium lamp and a mercury arc lamp which use the arc discharge, and comprises a neon sign which uses a luminescence generated by the glow discharge, and the like.

A fluorescent lamp or fluorescent tube is a gas-discharge lamp that uses electricity to excite mercury vapor. The excited mercury atoms produce short-wave ultraviolet light that then causes a phosphor to fluoresce, producing visible light. The fluorescent lamp is connected with a ballast in serial for preventing from increasing of current, where the ballast is a choke coil that coils are wound around an iron core. Besides, light in the fluorescent lamp is emitted by a discharge in a low pressure mercury vapor. As a general characteristic of the discharge lamp, since the voltage required for the discharge goes down when electric current flows, a predetermined voltage must be applied to generate the discharge. When the electric current increases excessively, the lamp may be breakdown. Accordingly, a ballast is connected with the lamp in serial to prevent from increasing of current. In principle, a metal resistor instead of the ballast may be used, but since the heat is generated by the current, a choke coil with a small generation of heat is used. In order to construct a lighting apparatus, the ballast is connected with a fluorescent lamp in serial, and both ends of the lamp are connected with a switch or a glow switch in parallel.

An optic output of a usual fluorescent lamp of a bulb type is seriously affected by a temperature of the lamp. For example, when a temperature of the lamp is 40° C., the optic output is maximized. When a temperature of the lamp is a low temperature, a lighting of the lamp turns off and the optic output is declined obviously. Also, when a temperature of the lamp is a high temperature, for example, over 70° C., the optic output is declined. Above all, when a temperature of the lamp is over 100° C., a saturation state occurs due to increase of a mercury vapor pressure sealed in the inside of the lamp, and accordingly, the optic output of the lamp is declined over 30%, and the durability of the lamp is declined obviously.

In addition, the heat generated in the lamp as a lighting apparatus of the discharge lamp is applied to an electronic ballast. Since a durability of the electronic ballast becomes different with a temperature, the fault of the electronic ballast may increase when the temperature rises.

On the other hand, as a high intensity discharge lamp in which the electronic ballast is embedded, a discharge lamp within 30~100 W to 105~210 W is mostly used. But, due to a self-heat generation of the high intensity discharge lamp, a durability of the electronic ballast may reduce and an improper lighting of the discharge lamp may occur frequently. Above all, the discharge lamp over 100 W is mostly out of use now due to the heat generated in the lamp.

Besides, when an internal temperature of the electronic ballast is over 85° C., electronic components embedded in the electronic ballast begins to a burning damage, and when an internal temperature of the electronic ballast is over 100° C., the electronic ballast is impossible to use as a lighting apparatus.

SUMMARY OF THE INVENTION

Accordingly, in order to overcome the above-mentioned drawbacks of the prior art, the present invention may be directed to provide a cooling apparatus of a discharge lamp capable of cooling the heat generated in an electronic ballast by means of inserting a heat emitting cover with a plurality of heat emitting openings between a lamp holding cover and a base holding cover in which the electronic ballast is embedded, and of attaching a heat spreading plate with cooling pins to the electronic components having much generation of heat among electronic components embedded in the electronic ballast.

Also, the present invention may be directed to provide a cooling apparatus of a discharge lamp capable of cooling the heat generated in an electronic ballast and the heat generated in the lamp by means of establishing a cooling fan on the heat spreading plate which is attached to the electronic ballast.

The present inventions may provide a cooling apparatus of a discharge lamp, the discharge lamp is composed of a base holding cover having a base on which an external power source is applied; a lamp holding cover for holding and supporting a plurality of lamps; and, an electronic ballast which converts the external power source into a power source for turning on the lamps, the cooling apparatus comprising: a heat spreading plate for radiating a heat in the discharge lamp; and a heat emitting cover interposed between the base holding cover and the lamp holding cover, in which a plurality of heat radiating openings are formed so as to emit the radiated heat by the heat spreading plate into the outside, wherein the heat spreading plate comprises a plurality of cooling pins, and the heat spreading plate is attached into a plurality of transistors embedded into the electronic ballast.

The present inventions may provide a cooling apparatus of a discharge lamp further comprising a cooling fan being attached into the heat spreading plate and for cooling the heat radiated by the heat spreading plate.

The present inventions may provide a cooling apparatus of a discharge lamp, wherein the electronic ballast comprises a thermostat connected with the cooling fan in parallel so as to drive the cooling fan on condition that a present temperature exceeds a predetermined temperature.

DETAILED DESCRIPTION OF EXEMPLARY EMBODIMENT(S)

The embodiments of the present inventions are not to be limited in scope by the specific embodiments described herein, from the foregoing description and accompanying drawings. Indeed, various modifications of the embodiments of the present inventions, in addition to those described herein, will be apparent to those of ordinary skill in the art from the foregoing description and accompanying drawings. Thus, such modifications are intended to fall within the scope of the following appended claims.

Figure 1:
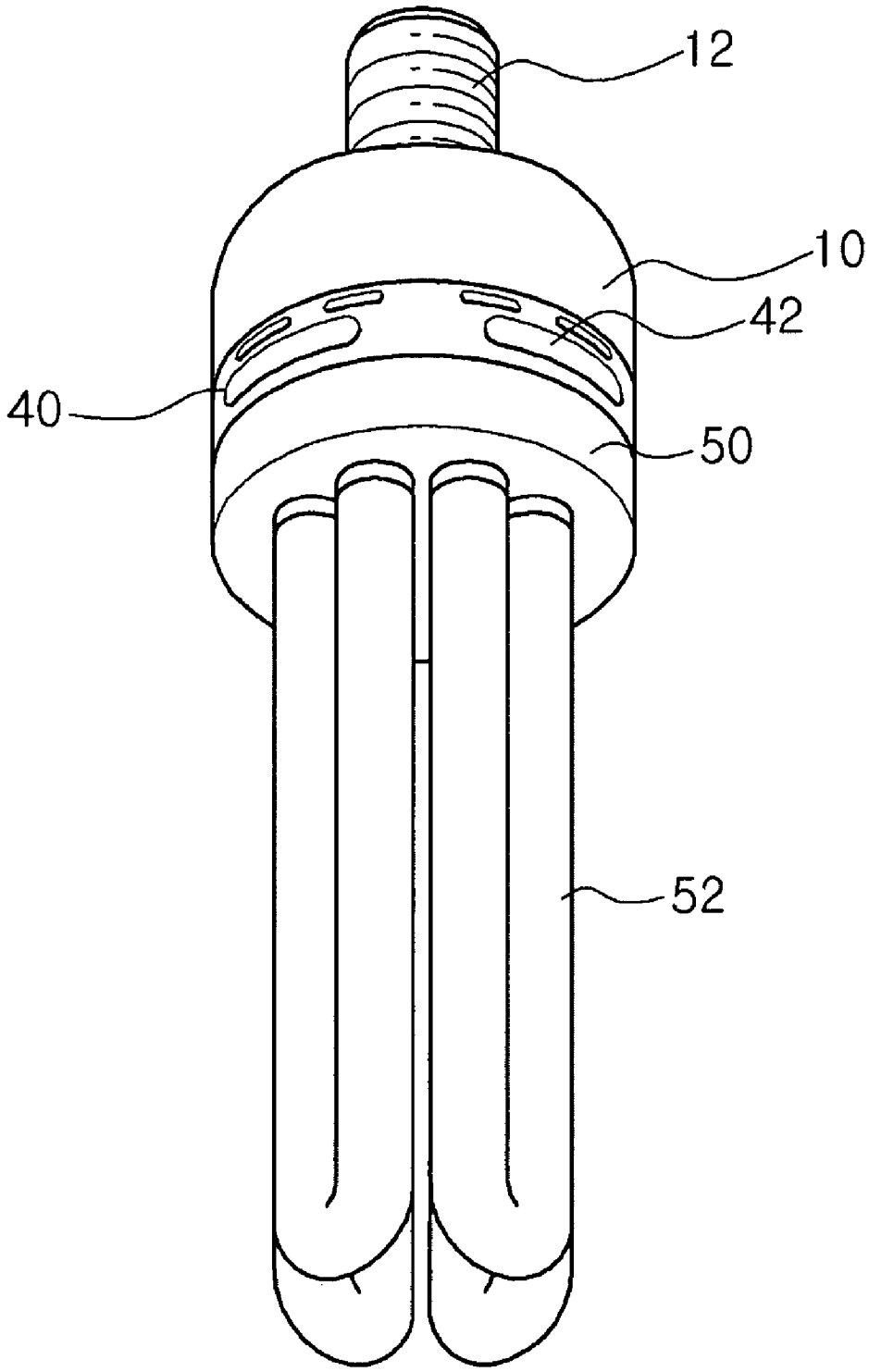
FIG. 1 is a perspective view illustrating an state with which a cooling apparatus of a discharge lamp is assembled according to an embodiment of the present invention.
Figure 2:
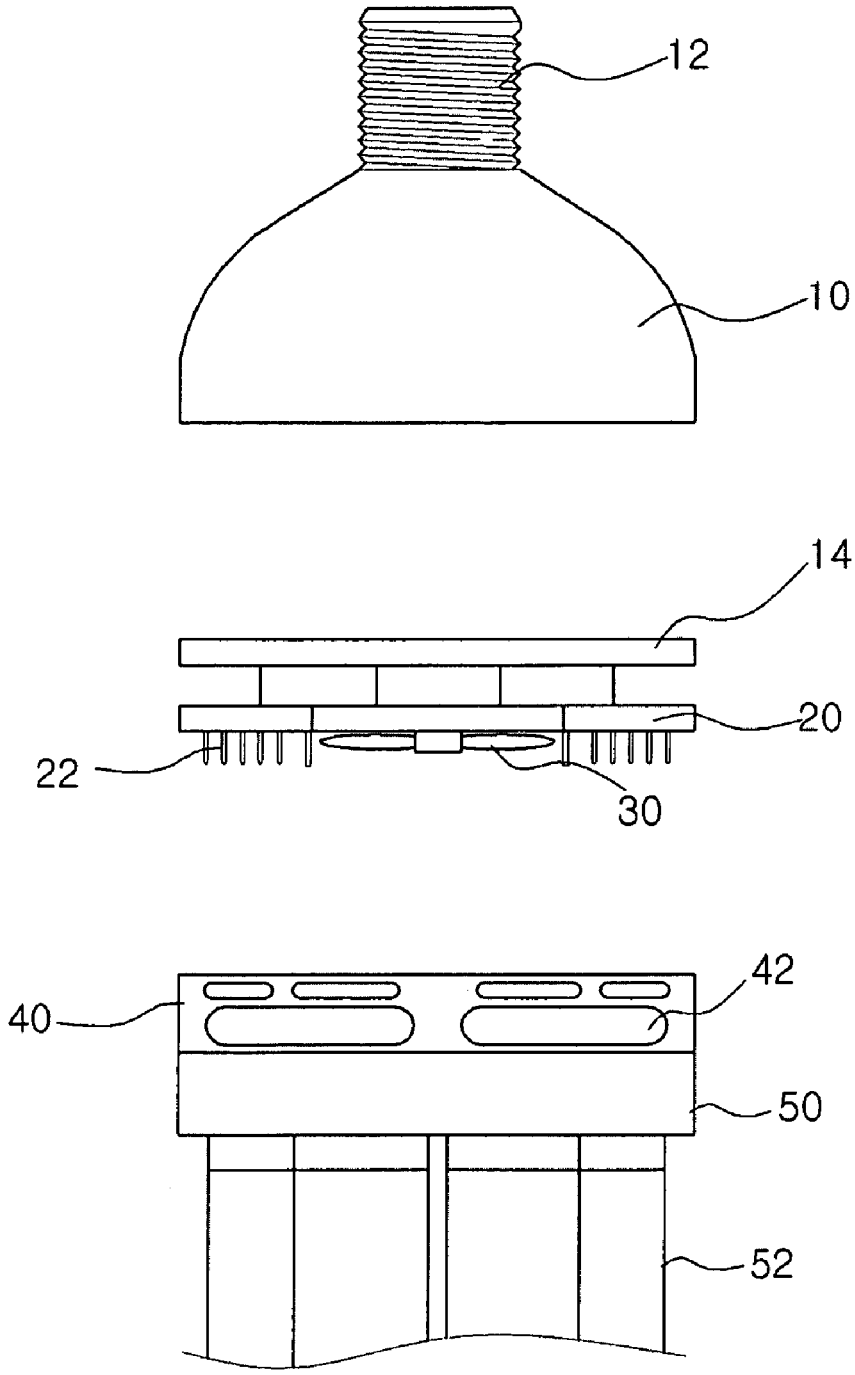
FIG. 2 is a side view illustrating a state from which a cooling apparatus of a discharge lamp is disassembled according to an embodiment of the present invention.
Figure 3:
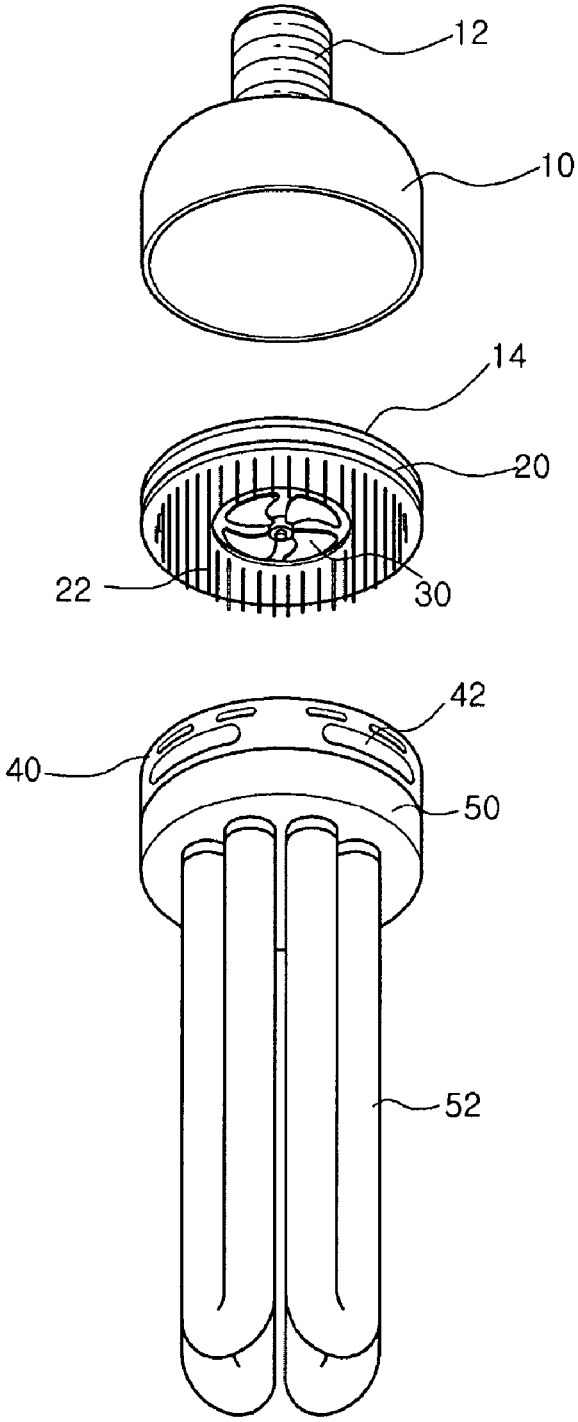
FIG. 3 is a perspective view illustrating a state from which a cooling apparatus of a discharge lamp is disassembled according to an embodiment of the present invention.
Figure 4:
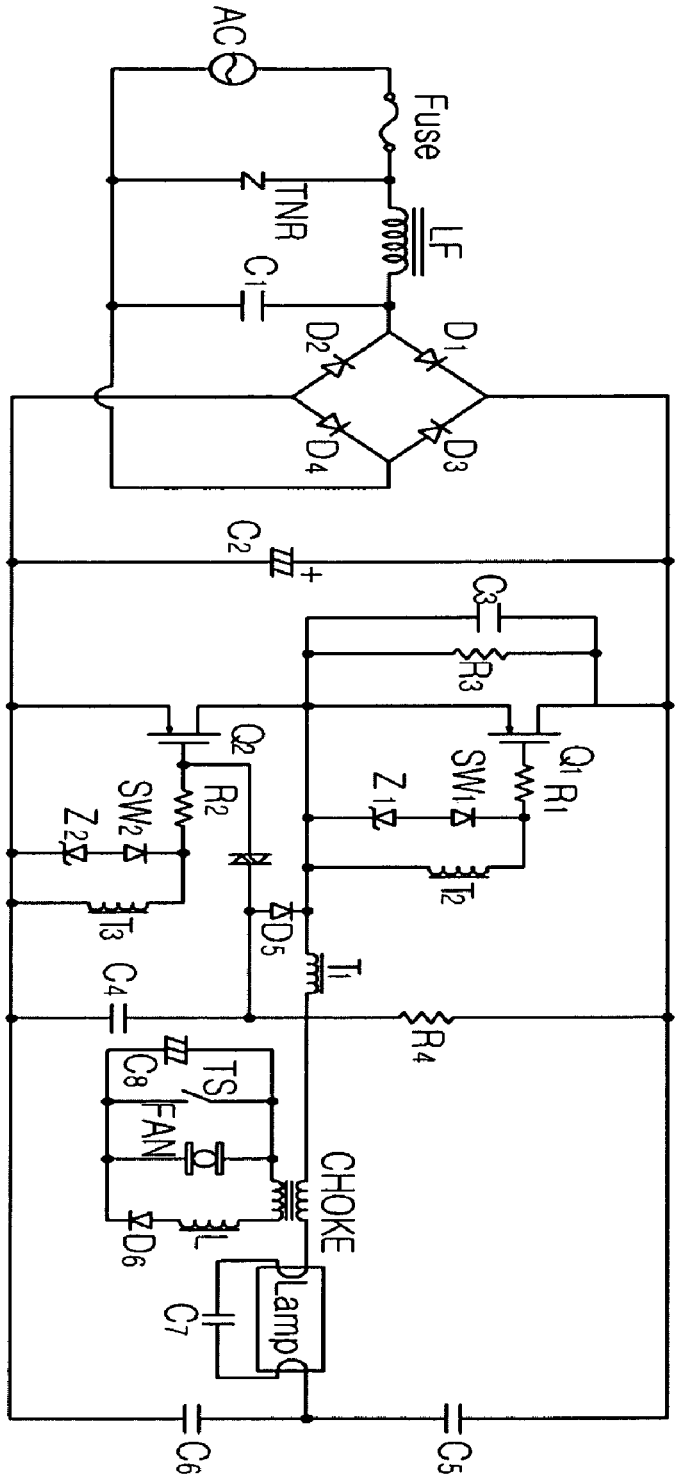
FIG. 4 is a circuit diagram showing an electronic ballast of a cooling apparatus of a discharge lamp according to an embodiment of the present invention.

FIG. 1 is a perspective view illustrating an state with which a cooling apparatus of a discharge lamp is assembled according to an embodiment of the present invention. FIG. 2 is a side view illustrating a state from which a cooling apparatus of a discharge lamp is disassembled, and FIG. 3 is a perspective view illustrating a state from which a cooling apparatus of a discharge lamp is disassembled. FIG. 4 is a circuit diagram showing an electronic ballast of a cooling apparatus of a discharge lamp.

Referring to FIGS. 1 to 4, a discharge lamp according to an embodiment of the present invention comprises a base holding cover 10 having a base 12 on which an external power source is applied, a lamp holding cover 50 for holding and supporting a plurality of lamps 52, and an electronic ballast 14 which converts the external power source into a power source for turning on the lamps.

To begin with, a discharge lamp includes a base holding cover 10 with a base (or socket) 12 in which an external power source is applied. The base 12 has a terminal to which an external alternative power source is provided. The base holding cover 10 may be an Edison type, in which male screw thread of a rotation type is combined with female screw thread of a holder by turning the female screw. The base holding cover 10 has a forms of a semicircle type in which an electronic ballast 14 is embedded, and is made of an insulating material such as a ceramic, a PBT (Polybutylene Terephthalate) plastic or the like.

The electronic ballast 14 is a high intensity ballast which converts the external alternative power source into a power source for turning on a plurality of lamps 52. The lamp holding cover 50 is to hold and support a plurality of lamps 52, and is connected with a wire or a contact point so that the power source provided from the electronic ballast 14 may be connect with the lamps 52.

The heat emitting cover 40 is interposed between the base holding cover 10 and the lamp holding cover, and the heat emitting cover 40 has a plurality of heat emitting openings 42 formed to emit the heat generated in a heat spreading plate 20 to the outside. The heat spreading plate 20 is attached to a bottom of the electronic ballast 14, and is preferably attached to a plurality of FET (Field Effect Transistor) Q1, Q2 which is embedded in the electronic ballast 14. At a bottom side of the heat spreading plate 20, a plurality of cooling pins 22 are formed. The heat spreading plate 20 may be made of a material having a high thermal conduction rate such as an aluminum and the like. The heat emitting cover 40 has a shape of a ring of which the diameter is substantially the same as diameters of the base holding cover 10 and the lamp holding cover 50. At a circumference side of the heat emitting cover 40, a plurality of heat emitting openings 42 are passed through the heat emitting cover 40 so as to emit the heat. The lamp holding cover 50 and the heat emitting cover 40 may be made of a thermoelectric material such as a ceramic and the like, in which the thermoelectric material has a low resistivity and a low thermal conductivity.

In addition, the cooling fan 30 is attached to the heat spreading plate 20, and cools the heat radiated from the heat spreading plate 20. The cooling fan 30 is activated by a power source provided from the electronic ballast 14. Above all, a thermostat TS in the electronic ballast 14 may be connected with the cooling fan 30 in parallel so as to drive the cooling fan 30 at a predetermined temperature by the thermostat TS. In order to drive the cooling fan 30 at all times, the thermostat TS connected with the cooling fan 30 in parallel may be removed.

For example, the high intensity discharge lamp over 100 W according to the prior art are difficult to mostly use due to the heat radiated in the lamp 52. The cooling apparatus of the discharge lamp, however, according to an embodiment of the present invention having the above mentioned structure adopts the heat emitting cover 40 with the plurality of the heat emitting openings 42 and the heat spreading plate 20 with the cooling pins, and accordingly, the heat generated in the electronic ballast 14 may be radiated to the outside.

Besides, since the cooling fan 30 is attached to the heat spreading plate 20, the heat generated in the electronic ballast 14 is emitted to the outside through the heat emitting openings 42 of the heat emitting cover 40 by means of the cooling fan 30, and the heat generated in the lamps 52 is not transferred to the electronic ballast 14 so that the electronic ballast 14 may be normally worked at an appropriate temperature not to overheat.

Also, since the wind provided from the cooling fan 30 is vented to the lamp 52 via the heat emitting openings 42, the heat may be not transferred to the electronic ballast 14, and the lamp 52 may be cooled at the same time. Accordingly, since to suppress a temperature rise of the lamp 52 may prevented from a saturation state due to increase of a mercury vapor pressure in the lamp 52, an optical output efficiency of a discharge lamp may increase and a durability of an embedded electronic ballast may improve.

In the cooling apparatus according to an embodiment of the present invention, the heat emitting cover 40 is interposed between the lamp holding cover 50 and the base holding cover 10 which are applicable to the discharge lamp with a high intensity, for example, 30~85 W to 100~210 W, and the heat spreading plate 20 in which a circuit board of the electronic ballast is attached at a upper side of the heat emitting cover 40 is provided.

Besides, among the electronic components of the electronic ballast 14, the transistors Q1, Q2 or the like may be adhered to the heat spreading plate 20 so as to radiate the heat. If only the heat spreading plate 20 is not enough to radiate the heat in a high intensity discharge lamp over 100 W, the cooling fan 30 is attached to the heat spreading plate 20. Accordingly, the heat generated in the electronic ballast 14 is radiated in a direction of the lamp 52 through the heat emitting openings 42 of the heat emitting cover 40, and then the wind provided from the cooling fan 30 may block the heat generated in the lamp 52 not to transfer to the electronic ballast 14.

Experimental results are followed in relation to the discharge lamp in which the high intensity electronic ballast is embedded. In case where a heat spreading plate 20 is not applied, or where both a heat spreading plate 20 and a cooling fan 30 is not applied, an internal temperature of the electronic ballast 14 in the discharge lamp of 40~85 W was overheated over 80° C., an internal temperature of the electronic ballast 14 in the discharge lamp over 100 W was overheated over 95° C., and an internal temperature of the electronic ballast 14 in the discharge lamp over 150 W was overheated over 110° C. Accordingly the electronic ballast 14 was breakdown due to the overheat, or the durability of the discharge lamp was deteriorated excessively.

Therefore, in case where the heat spreading plate 20 according to the embodiment of the present invention was applied to the high intensity discharge lamp of 40~85 W, a sufficient radiation of the heat was accomplished. In case where both heat spreading plate 20 and the cooling fan 30 were applied to the high intensity discharge lamp of 100~210 W, the heat generated in the electronic ballast 14 was emitted, and the heat transferred from the lamp 52 was blocked and cooled down.

As shown in FIG. 4, the cooling fan 30 may be worked by a choke transformer Choke, an inductor L, a diode D6, a electrolytic condenser C7, and a power source circuit of DC 12V at a 70~90° C. working temperature of a thermostat TS. In the circuit diagram, when a 70 working temperature of a thermostat TS is used, the cooling fan 30 is not worked below 70° C. The cooling fan 30 at a 70° C. or more is worked so that a temperature of the electronic ballast is lowered below 70° C., and the cooling fan 30 is not worked when the thermostat TS becomes below 70° C. Accordingly, a working temperature of the cooling fan 30 may be varied according to a selection of the thermostat TS. In order to drive the cooling fan 30 at all times when the lamp 52 turns on, the thermostat TS may be removed.

As a result, according to the cooling apparatus, the heat generated in the electronic components of the electronic ballast may be radiated to the outside via the heat spreading plate and through the cooling pins which are formed in the heat spreading plate, and the heat radiated by the cooling pins may be emitted through the heat emitting openings. Accordingly, a durability of an embedded electronic ballast may improve, and the normal lighting of the lamp is accomplished. Besides, the heat generated in the electronic ballast is cooled down by means of a cooling fan which is attached to the heat spreading plate, the heat generated in the lamp is blocked not to be transferred to the electronic ballast so that the lamp may be cooled down, and then an optical output efficiency of a discharge lamp may increase.

The embodiment of the present inventions are not to be limited in scope by the specific embodiments described herein. Indeed, various modifications of the embodiment of the present inventions, in addition to those described herein, will be apparent to those of ordinary skill in the art from the foregoing description and accompanying drawings. Thus, such modifications are intended to fall within the scope of the following appended claims. Further, although the embodiment of the present inventions have been described herein in the context of a particular implementation in a particular environment for a particular purpose, those of ordinary skill in the art will recognize that its usefulness is not limited thereto and that the embodiment of the present inventions can be beneficially implemented in any number of environments for any number of purposes. Accordingly, the claims set forth below should be construed in view of the full breath and spirit of the embodiment of the present inventions as disclosed herein.

The invention claimed is:

1. A cooling apparatus of a discharge lamp, the discharge lamp is composed of a base holding cover having a base on which an external power source is applied; a lamp holding cover for holding and supporting a plurality of lamps, an electronic ballast which converts the external power source into a power source for turning on the lamps, a heat emitting cover interposed between the base holding cover and the lamp holding cover, in which a plurality of heat radiating openings are formed so as to emit the radiated heat by a heat spreading plate into the outside, the heat spreading plate attached to the electronic ballast, a cooling fan to cool the heat radiated to the heat spreading plate, the electronic ballast comprising a thermostat wherein a thermal switch in said thermostat extinguishes the external power source upon exceeding a certain predetermined temperature and wherein the cooling fan is connected with the thermostat in parallel so as to drive the cooling fan by means of the thermostat when the temperature reaches a certain predetermined temperature, wherein the heat spreading plate further comprises cooling pins directly connected to a plurality of transistors embedded into the electronic ballast.

* * * * *